US008584663B2

(12) United States Patent
Kim et al.

(10) Patent No.: US 8,584,663 B2
(45) Date of Patent: Nov. 19, 2013

(54) COOLING AND EXHAUST SYSTEM OF DUAL ELECTRIC OVEN

(75) Inventors: Wan Soo Kim, Seoul (KR); Hyeun Sik Nam, Seoul (KR); Jae Kyung Yang, Seoul (KR); Dong Seong Kwag, Seoul (KR); Seong Ho Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 1015 days.

(21) Appl. No.: 12/230,025

(22) Filed: Aug. 21, 2008

(65) Prior Publication Data

US 2009/0050130 A1 Feb. 26, 2009

(30) Foreign Application Priority Data

Aug. 24, 2007 (KR) ..... 10-2007-0085763

(51) Int. Cl.
*F24C 15/32* (2006.01)

(52) U.S. Cl.
USPC .... 126/21 A; 126/214; 126/273 R; 126/21 R; 219/400; 219/506; 219/411

(58) Field of Classification Search
USPC ..... 126/21 A, 193, 198, 214; 219/757, 400
See application file for complete search history.

(56) References Cited

U.S. PATENT DOCUMENTS

| | | | | |
|---|---|---|---|---|
| 6,730,881 | B1 * | 5/2004 | Arntz et al. | 219/400 |
| 6,761,159 | B1 | 7/2004 | Barnes et al. | |
| 6,913,012 | B2 * | 7/2005 | Divett et al. | 126/21 A |
| 6,933,477 | B2 * | 8/2005 | Becker et al. | 219/506 |
| 6,967,310 | B2 * | 11/2005 | Austin et al. | 219/408 |
| 7,708,008 | B2 * | 5/2010 | Elkasevic et al. | 219/394 |
| 7,808,008 | B2 * | 10/2010 | Miyake | 257/80 |

FOREIGN PATENT DOCUMENTS

| | | | |
|---|---|---|---|
| JP | 16-219057 | A | 8/2004 |
| KR | 20-0349536 | Y1 | 5/2004 |
| KR | 10-2005-0081673 | A | 8/2005 |

* cited by examiner

*Primary Examiner* — Steven B McAllister
*Assistant Examiner* — Nikhil Mashruwala
(74) *Attorney, Agent, or Firm* — McKenna Long & Aldridge LLP

(57) ABSTRACT

A cooling and exhaust system of a dual oven has upper and lower ovens, in which, in one aspect, an installation structure of a cooling fan and an exhaust structure provided for respectively cooling and exhausting the upper and lower ovens may be integrated into a simplified structure having common components to increase the manufacturing productivity. In another aspect, fans provided at the upper and lower ovens may be independently controlled to operate at different speeds according to a desired operation to maximize the cooling efficiency.

1 Claim, 7 Drawing Sheets

COOLING AND EXHAUST SYSTEM OF DUAL ELECTRIC OVEN

This application claims the benefit of Korean Patent Application No. 10-2007-0085763, filed on Aug. 24, 2007, which is hereby incorporated by reference in its entirety.

BACKGROUND

1. Field of the Disclosure

The disclosure relates to a dual oven, and more particularly, to a cooling and exhaust system of a dual oven having upper and lower ovens, in which an installation structure of a cooling fan and an exhaust structure provided for respectively cooling and exhausting the upper and lower ovens may be integrated into a simplified structure. For instance, common components may be used to increase the manufacturing productivity, and fans provided in the upper and lower ovens may be independently controlled to operate at different speeds according to a desired operation in order to maximize the cooling efficiency.

2. Description of the Related Art

Generally, electric ovens are used for cooking food placed in its cooking chamber using heat generated by a ceramic heater, a sheath heater, a halogen heater or a high-frequency generating device such as, for example, a magnetron. The food in the cooking chamber can be cooked relatively fast since inner and outer portions of the food can be simultaneously cooked. Electric ovens are also safe to use and have high thermal efficiency. Thus, the use of electric ovens is increasing. Particularly, the use of dual electric ovens which can accommodate and cook a great volume of food due to having upper and lower ovens is becoming widespread.

FIG. 1 illustrates a perspective view of a front side of a conventional dual electric oven, FIG. 2 illustrates a cutaway perspective view of main components of the dual electric oven shown in FIG. 1, and FIG. 3 illustrates a perspective view of a rear side of the dual electric oven shown in FIG. 1.

As shown in FIGS. 1 to 3, a dual electric oven 2 includes an upper oven 4 provided at an upper portion of a front frame 12 and a lower oven 8 provided below the upper oven 4.

The upper oven 4 includes a housing 5 which includes a cooking chamber 6, an upper door 14 provided with a handle 15 and a window 22 where the upper door 14 opens and closes on the cooking chamber 6, an upper heater 42 provided at an upper side of the cooking chamber 6 to provide high heat in the cooking chamber 6, a lower heater (not shown) provided at a lower side of the cooking chamber 6 to provide heat through a bottom wall of the cooking chamber 6, a convection fan 44 provided at an inner rear side of the cooking chamber 6, and a fan 144 for cooling the upper oven 4 and exhausting hot air during a self-cleaning operation.

The lower oven 8 has similar structures, and thus, description thereof will be skipped.

Operating buttons for operating the upper and lower ovens 4 and 8 and a control panel 50 for checking operating statuses of the upper and lower oven 4 and 8 are provided on the upper portion of the front frame 12, and an exhaust outlet 13 is provided on a lower portion of the front frame 12.

The fan 144 for cooling and exhausting air from the upper oven 4 is installed in an air box or compartment 80 provided on the upper portion of the housing 5. The fan 144 includes an exhaust unit 146 and a cooling unit 148. The exhaust unit 146, during the self-cleaning operation of the upper oven 4, exhausts hot air A1 from the cooking chamber 6 through a plurality of holes 139 formed between the cooking chamber 6 and the air box 80 to an exhaust duct 89 formed between the housing 5 and a cover case 88. The cooling unit 148 directs cooling air B1 for cooling the upper oven 4 to the exhaust duct 89. A partition plate 150 for separating the hot exhaust air A1 and the cooling air B1 is also provided in the air box 80.

FIG. 3 illustrates flow of the hot exhaust air A1 and the cooling air B1 on the rear side of the dual electric oven 2 shown in FIG. 1. Through the fan 144 of the upper oven 4, the hot exhaust air A1 and the cooling air B1 are directed to the exhaust duct 89 formed between the cover case 88 and outer surfaces of the housing 5 and 7 respectively which cover the upper and lower oven 4 and 8. Then, the hot exhaust air A1 and the cooling air B1 pass through a lower exhaust passage 194 formed on a lower portion of the lower oven 8 to be eventually exhausted from the outlet 13 shown in FIG. 1. On the other hand, hot exhaust air A2 and cooling air B2 are directed through the fan 174 of the lower oven 8 to the exhaust duct 89 formed between the cover case 88 and the outer surface of the housing 7 which covers the lower oven 8. Then, the hot exhaust air A2 and the cooling air B2 pass through the lower exhaust passage 194 to be exhausted from the outlet 13. Reference numeral 196 indicates a motor for operating the convection fan 44 of the upper oven 4, reference numeral 196' indicates a motor for operating a convection fan (not shown) of the lower oven 8. Reference numerals 200 and 204 respectively indicate a first partition plate for separating the hot exhaust air A1 and the cooling air B1 and a second partition plate for separating the hot exhaust air A2 and the cooling air B2.

SUMMARY

In the above-described dual electric oven 2, the hot exhaust air A1 directed through the fan 144 of the upper oven 4 flows at a right side of the dual electric oven 2, the exhaust air A2 directed through the fan 174 of the lower oven 8 flows at a left side of the dual electric oven 2, and the cooling air B1 and the cooling air B2 flow at a middle portion of the dual electric oven 2. As such, the fan 144 of the upper oven 4, a motor (not shown) for operating the fan 144, the fan 174 of the lower oven 8, and a motor (not shown) for operating the fan 174 are respectively installed at different locations throughout the dual electric oven 2, which complicates the manufacturing process and could result in assembly errors. Further, the housing 5 and 7 respectively for the upper and lower ovens 4 and 8 may be separately manufactured, which increases the number of parts required to manufacture the dual electric oven 2, resulting in increased manufacturing time and cost, and hence decreased productivity.

Accordingly, a cooling and exhaust system of a dual electric oven that substantially obviates one or more problems due to limitations and disadvantages of the related art is disclosed.

It is an aspect of the present invention to provide a cooling and exhaust system of a dual electric oven having upper and lower ovens, in which an installation structure of a cooling fan and an exhaust structure provided for respectively cooling and exhausting the upper and lower ovens may be integrated into a simplified structure having common components to increase the manufacturing productivity, and fans provided in the upper and lower ovens may be independently controlled to operate at different speeds according to a desired operation to maximize the cooling efficiency.

Additional advantages, aspects, and features of the invention will be set forth in part in the description which follows and in part will become apparent to those having ordinary skill in the art upon examination of the following or may be learned from practice of the invention.

In accordance with one aspect of the present invention, the above-identified and other advantages are achieved by a cooling and exhaust system for a dual oven. System comprises a first air inlet associated with an upper oven and a second air inlet associated with a lower oven. The system also comprises an exhaust outlet and an exhaust duct at the rear of the dual oven, where the exhaust passage connects the exhaust duct and the exhaust outlet. Still further, the system comprises a first fan directing cooling air through the first air inlet and directing hot air exhausted from the upper oven into the exhaust duct; and a second fan directing cooling air through the second air inlet and directing hot air exhausted from the lower oven into the exhaust duct, wherein the first fan and the second fan are positioned at the rear of the dual oven and vertically aligned with one another.

In accordance with another aspect of the present invention, the above-identified and other advantages are achieved by a cooling and exhaust system of a dual oven, where the system comprises a first fan associated with an upper oven, the first fan controlled by a first motor. The system also comprises a second fan associated with a lower oven, the second fan controlled by a second motor, wherein the first motor and the second motor are positioned at the rear of the upper and lower ovens, respectively, and vertically aligned with one another. The system further includes an exhaust passage that receives air directed by the first fan and the second fan.

In accordance with yet another aspect of the present invention, the above-identified and other advantages are achieved by dual oven including a cooling and exhaust system, the oven comprising a first oven including a first motor that controls a first fan and a second oven including a second motor that controls a second fan, wherein the first motor and first fan are positioned to the rear of the first oven and the second motor and second fan are positioned to the rear of the second oven, and wherein the position of the first motor and first fan, relative to the first oven, is the same as the position of the second motor and second fan relative to the second oven. The oven further comprises a first partition positioned so that it separates cooling air received from a first inlet and exhaust air exhausted from the first oven at an inlet side of the first fan and a second partition positioned so that is separates cooling air and the exhaust air at an outlet side of the first fan. The oven also comprises a third partition plate positioned such that it separates cooling air received from a second inlet and exhaust air exhausted from the second oven at an inlet side of the second fan and a fourth partition plate positioned such that it separates cooling air and exhaust air at an outlet side of the second fan. Still further, the oven includes an exhaust passage that receives the cooling air and the exhaust air directed by the first fan and the second fan.

The fan controller controls the first fan to operate at high speed and the second fan to operate low speed during a self-cleaning operation of the upper oven and controls the first fan to operate at low speed and the second fan to operate high speed during a self-cleaning operation of the lower oven.

The cooling and exhaust system may further include a first partition plate provided at an inlet side of the first fan to separate the cooling air introduced from the first air inlet and the hot air exhausted from the upper oven.

The cooling and exhaust system may further include a second partition plate provided at an outlet side of the first fan to separate the cooling air and the hot exhaust air separated by the first partition plate and directed to the exhaust duct through the first fan.

The cooling and exhaust system may further include a third partition plate provided at an inlet side of the second fan to separate the cooling air introduced from the second air inlet and the hot air exhausted from the lower oven.

The cooling and exhaust system may further include a fourth partition plate provided at an outlet side of the second fan to separate the cooling air and the hot exhaust air separated by the third partition plate and directed to the exhaust duct through the second fan.

BRIEF DESCRIPTION OF THE DRAWINGS

The accompanying drawings, which are included to provide a further understanding of the disclosure and are incorporated in and constitute a part of this application, illustrate exemplary embodiment(s) of the invention and together with the description serve to explain the principle of the invention. In the drawings.

DETAILED DESCRIPTION OF THE EXEMPLARY EMBODIMENTS

Figure 1:
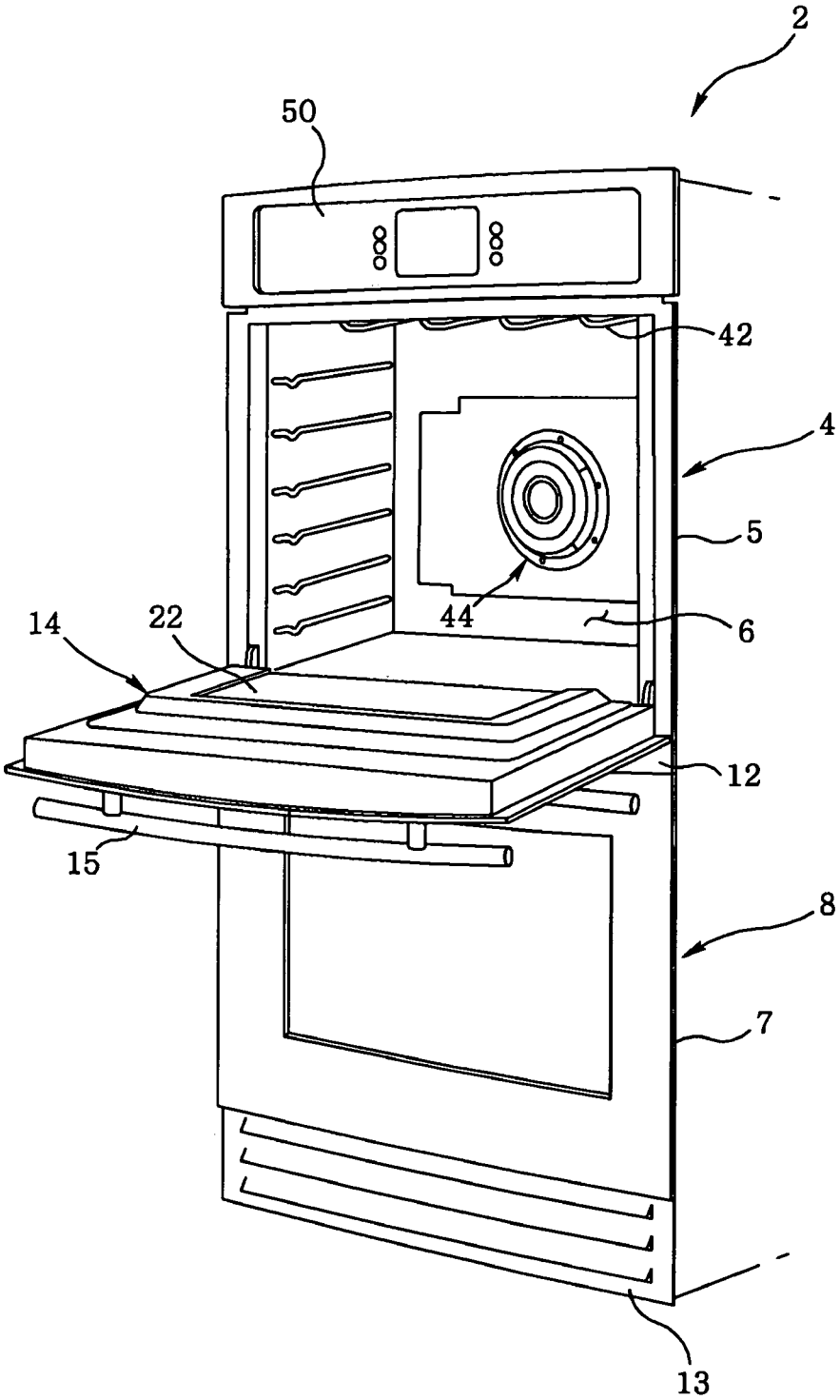
FIG. 1 illustrates a perspective view of a front side of a conventional dual electric oven.

Reference will now be made in detail to the exemplary embodiments of the present invention, examples of which are illustrated in the accompanying drawings. The invention may, however, be embodied in many different forms and should not be construed as being limited to the embodiments set forth herein. Rather, these embodiments are provided so that this disclosure will be thorough and complete, and to convey the concept of the invention to those skilled in the art. Wherever possible, the same reference numerals will be used throughout the drawings to refer to the same or like parts.

Figure 4:
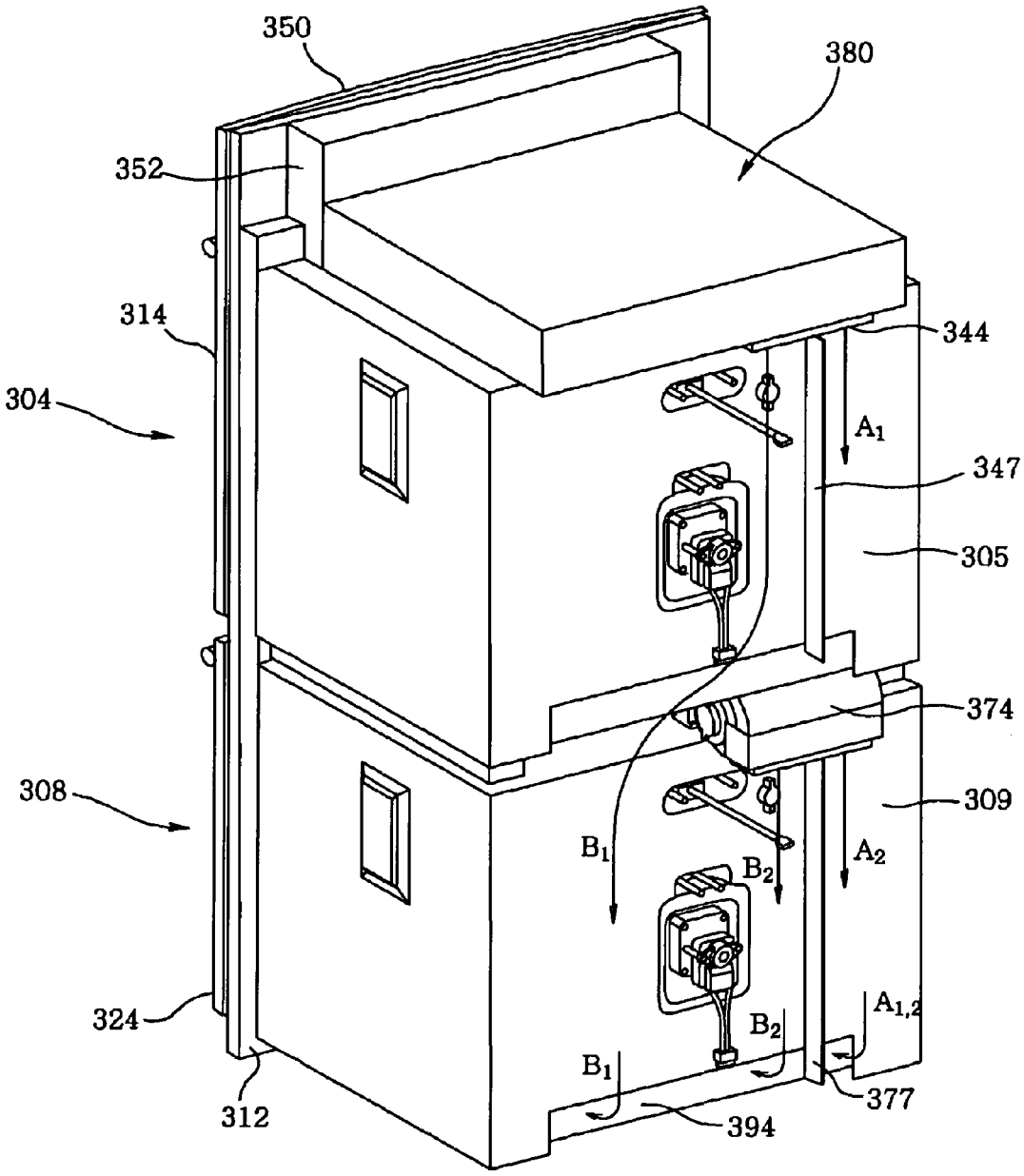
FIG. 4 illustrates a perspective view of a rear side of a dual electric oven having implemented with a cooling and exhaust system according to an exemplary embodiment of the present invention.
Figure 5:
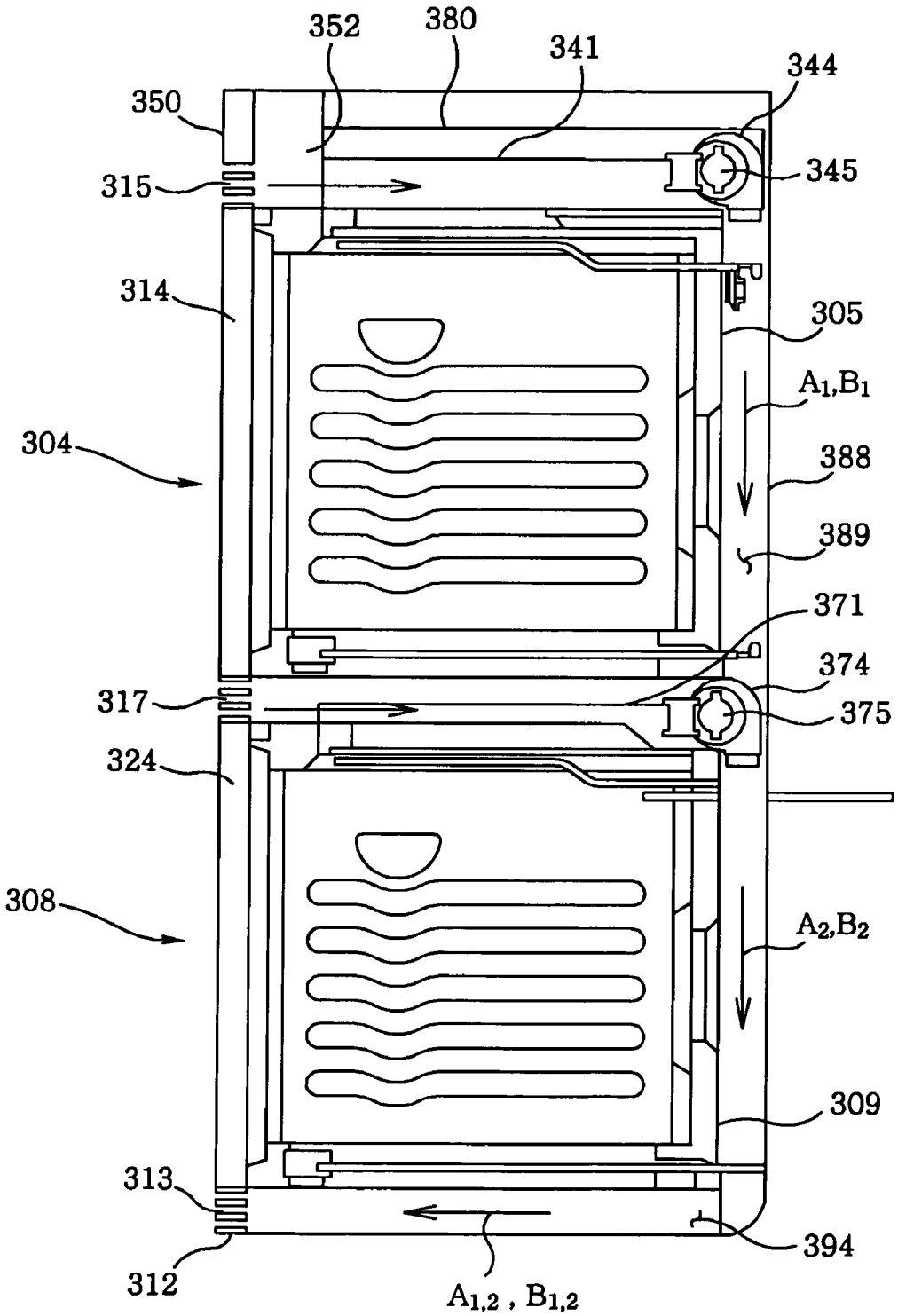
FIG. 5 illustrates a partial cross-sectional view of the dual electric oven shown in FIG. 4.
Figure 6:
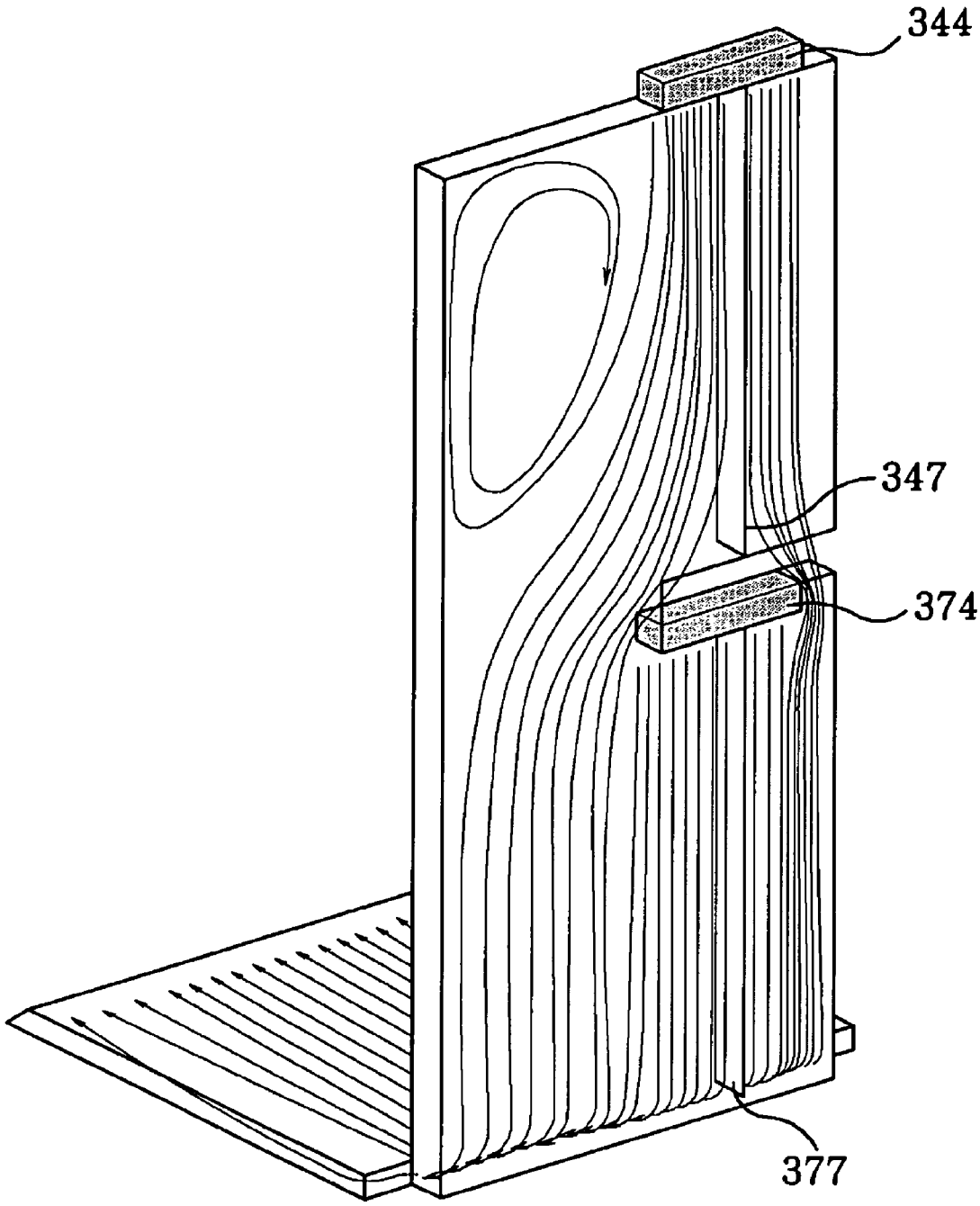
FIG. 6 illustrates flow of cooling air and hot exhaust air passed through a first fan and a second fan shown in FIG. 4.

FIG. 4 illustrates a perspective view of a rear side of a dual electric oven having implemented with a cooling and exhaust system according to an exemplary embodiment of the present invention, FIG. 5 illustrates a partial cross-sectional view of the dual electric oven shown in FIG. 4, and FIG. 6 illustrates flow of cooling air and hot exhaust air passed through a first fan and a second fan shown in FIG. 4.

Figure 2:
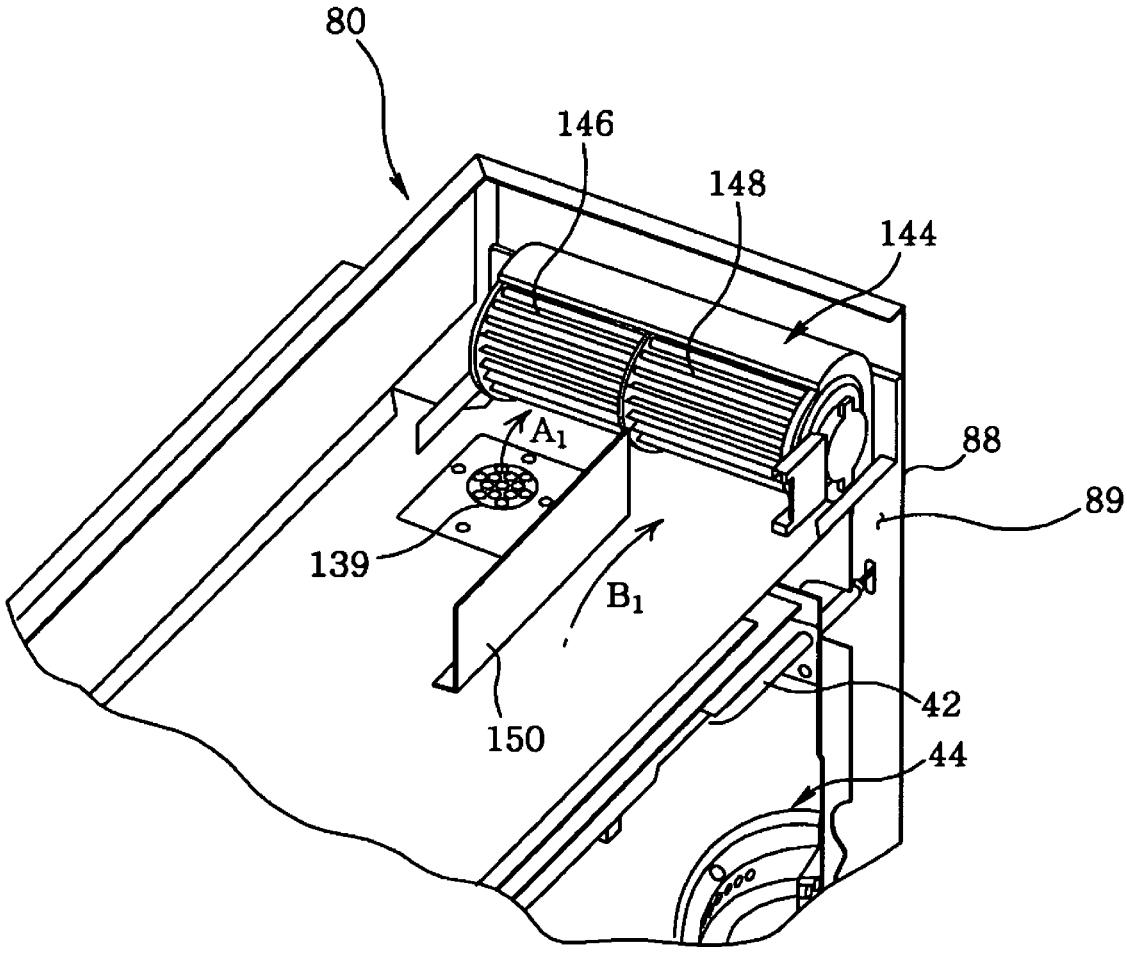
FIG. 2 illustrates a cutaway perspective view of main components of the dual electric oven shown in FIG. 1.
Figure 3:
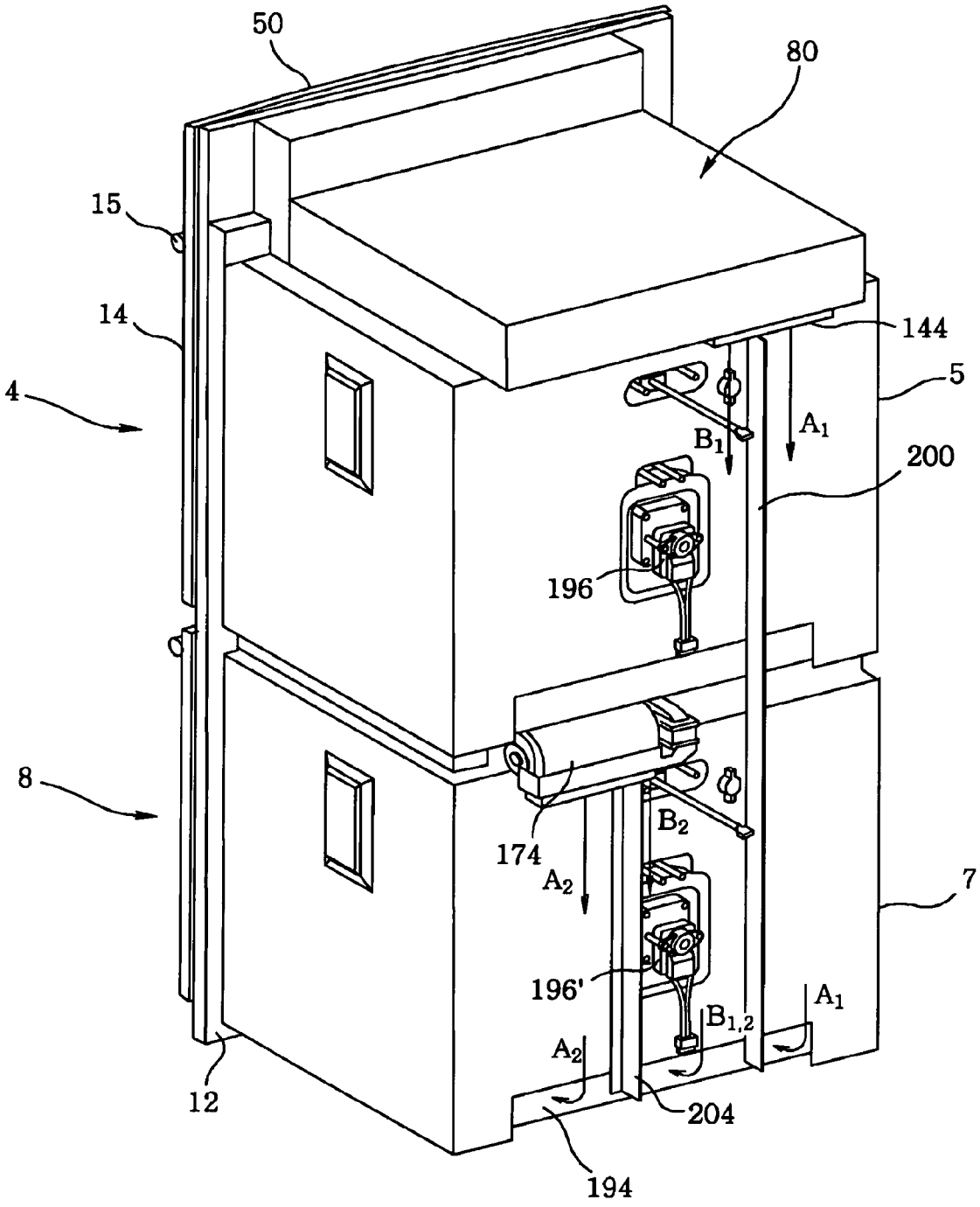
FIG. 3 illustrates a perspective view of a rear side of the dual electric oven shown in FIG. 1.

Herein below, in a dual electric oven having implemented with a cooling and exhaust system according to one embodiment of the present invention, description of the same or like components shared by a conventional dual electric oven shown in FIGS. 1 to 3 will be omitted. One skilled in the art would recognize that there are other embodiments of the present invention which can be realized based on the understanding of the disclosure.

As shown in FIGS. 4 and 5, a cooling and exhaust system of a dual electric oven includes a front frame 312 connected to an upper oven 304 and a lower oven 308 and formed with a first air inlet 315 provided at an upper portion of the front frame 312, a second air inlet 317 provided on a position between the upper oven 304 and the lower oven 308, and an exhaust outlet 313 provided at a lower portion of the front frame 312.

The front frame 312 is connected to a cover case 388 which covers the upper oven 304 and the lower oven 308. The cover case 388 also forms an exhaust duct 389 by defining an enclosed space at rear sides of the upper 304 and the lower oven 308.

Reference numeral 314 indicates a door provided at the upper oven 304, reference numeral 324 indicates a door provided at the lower oven 308, reference numeral 350 indicates operating buttons for operating the upper and lower oven 304 and 308 and a control panel for checking respective operating status of the upper and lower oven 304 and 308, reference numeral 352 indicates a control unit for controlling all operations of the upper and lower ovens 304 and 308, and reference numeral 380 indicates an air box.

A first fan 344 is provided at an upper side of a housing 305 of the upper oven 304 to direct cooling air introduced from the first air inlet 315 and hot air exhausted from the upper oven 304, for example, during a self-cleaning operation to the exhaust duct 389. Here, a motor 345 for operating the first fan 344 is provided by being coupled to a left side of the first fan 344.

On an inlet side of the first fan 344, a first partition plate 341 may be provided to separate the cooling air introduced from the first air inlet 315 and the hot air exhausted through a plurality of holes 139 from the upper oven 304. On an outlet side of the first fan 344, a second partition plate 347 may be provided to separate cooling air B1 and hot exhaust air A1 separated by the first partition plate 341 and directed to the exhaust duct 389 through the first fan 344. As described, since the cooling air introduced from the first air inlet 315 and the hot air exhausted from the upper oven 304 are not mixed due to the first and second partition plates 341 and 347, the cooling efficiency of the upper oven 304 may be increased.

A second fan 374 is provided at an upper side of a housing 309 of the lower oven 308 to direct cooling air introduced from the second air inlet 317 via a space formed between the upper oven 304 and the lower oven 308 and hot air exhausted from the lower oven 308 to the exhaust duct 389. Here, similar to the first fan 344, a motor 375 for operating the second fan 374 is provided by being coupled to a left side of the second fan 374. According to the cooling and exhaust system of a dual electric oven of the embodiment of the present invention, the first fan 344 and motor 345 may be referred to as a first fan-motor assembly. Similarly, the second fan 374 and the motor 375 may be referred to as a second fan-motor assembly. Further in accordance with the exemplary embodiments of the present invention, the first and the second fan-motor assemblies have the same structure and/or configuration. Thus, the number of common components can be increased which increases the productivity of the dual electric oven.

On the other hand, the second fan 374 may be provided at the same position or same side at which the first fan 344 is provided or at a position or side corresponding to the position or side at which the first fan 344 is provided. Here, the corresponding position may be a position adjacent to the position at which the first fan 344 is provided. That is, the corresponding position is a position that is on a right side of a fourth partition plate 377 shown in FIGS. 4 and 6, in which hot air A2 from the lower oven 308 exhausted through the second fan 374 can flow in the same direction as the hot air A1 from the upper oven 304 exhausted through the first fan 344, which is shown in FIGS. 4 and 6. This could be a case where the second fan 374 is provided at the same position at which the first fan 344 is provided. Since a plurality of holes (not shown) formed at the housing 309 of the lower oven 308 is formed in the same corresponding position where the plurality of holes 139 is formed at the housing 305 of the upper oven 304, the second fan 374 provided in the position corresponding to the position at which the first fan 344 is provided may direct the hot air A2 passing there through in the same direction as the hot air A1 from the upper oven 304 exhausted through the first fan 344. This could be a case in which the second fan 374 is provided at the same position at which the first fan 344 is provided. Here, the housing 305 of the upper oven 304 and the housing 309 of the lower oven 308 have the same structure. Thus, the number of common components can be increased which increases the productivity of the dual electric oven.

At an inlet side of the second fan 374, a third partition plate 371 may be provided to separate the cooling air introduced from the second air inlet 317 and the hot air exhausted through the plurality of holes 139 from the lower oven 308.

On an outlet side of the second fan 374, a fourth partition plate 377 may be provided to separate cooling air B2 and hot exhaust air A2 separated by the third partition plate 371 and directed to the exhaust duct 389 through the second fan 374. As described, since the cooling air introduced from the second air inlet 317 and the hot air exhausted from the lower oven 308 are not mixed due to the third and fourth partition plates 371 and 377, the cooling efficiency of the lower oven 308 may be increased.

Figure 7:
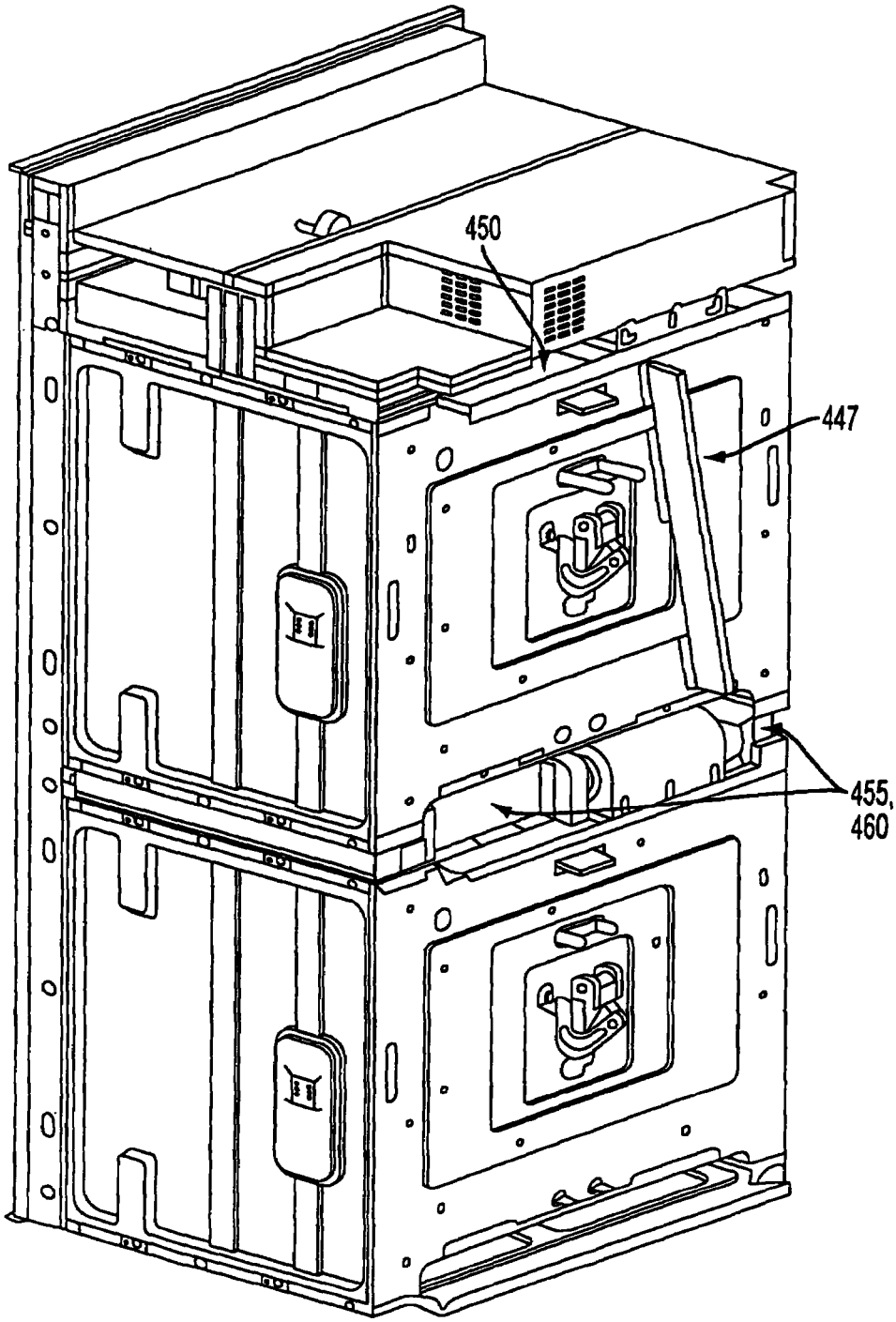
FIG. 7 is a perspective view of an alternative embodiment of the present invention.

FIG. 7 illustrates an alternative exemplary embodiment. As shown in FIG. 4, the orientation of the second partition 347 associated with the outlet side of the first fan 344 is vertical or substantially vertical. However, in the alternative embodiment of FIG. 7, the second partition 447 may be angled, as shown. By angling the second partition 447, the second partition 447 more gradually directs the airflow around the fan-motor assembly associated with the lower oven. This, in turn, will reduce any noise that occurs due to the airflow.

Further in accordance with the alternative embodiment illustrated in FIG. 7, one or more blocking plates 450, 455 and 460 may be employed. The blocking plates 450, 455 and 460 prevent backflow and airflow leakage in and around the fan-motor assemblies. At a lower portion of the housing 309 of the lower oven 308, a lower exhaust passage 394 connecting the exhaust duct 389 and the exhaust outlet 313 formed on the front frame 312 is provided.

A fan controller (not shown) for controlling respective speeds of the first fan 344 and the second fan 374 is provided in a control unit 352. The fan controller controls the first fan 344 to operate at high speed and the second fan 374 to operate low speed during a self-cleaning operation of the upper oven 304. Here, the second fan 374 is, for example, simultaneously operated to cool the lower oven 308 from heat transferred thereto from the upper oven 304 during the self-cleaning operation of the upper oven 304. The simultaneous operation of the second fan 374 may help the first fan 344 to exhaust the cooling air and the hot air passing through the exhaust duct 389 and the lower exhaust passage 394 to the exhaust outlet 313.

The fan controller controls the first fan 344 to operate at low speed and the second fan 374 to operate high speed during a self-cleaning operation of the lower oven 308. Here, the first fan 344 is, for example, simultaneously operated to cool the upper oven 304 from heat transferred thereto from the lower oven 308 during the self-cleaning operation of the lower oven 308, and to cool the control unit 352 provided on the upper side of the upper oven 304 from the heat generated therein.

As described above, according to the cooling and exhaust system of a dual electric oven of the embodiment of the present invention, the first fan 344 and the second fan 374 may be independently controlled to operate at different speeds by the fan controller according to a desired operation to increase both the cooling efficiency and the exhaust efficiency of the upper and lower ovens 304 and 308.

During a cooking mode of the upper oven 304 and/or the lower oven 308, the fan controller controls the first fan 344 and/or the second fan 374 to be basically operated in low speed, and appropriately controls the first fan 344 and/or the second fan 374 to be operated in high or low speeds according to respective cooking temperatures in the upper and lower ovens 304 and 308.

As described above, in the cooling and exhaust system of a dual electric oven having upper and lower ovens, according to the embodiment of the present invention, the installation structure of the cooling fan and the exhaust structure provided for respectively cooling and exhausting the upper and lower ovens can be integrated into a simplified structure having common components to increase the manufacturing productivity the of the dual electric oven.

Additionally, in the cooling and exhaust system of a dual electric oven having upper and lower ovens, according to the embodiment of the present invention, fans provided in the upper and lower ovens can be independently controlled to operate at different speeds according to a desired operation to maximize the cooling efficiency.

Although the invention has been described with reference to an exemplary embodiment, it is understood that the words that have been used are words of description and illustration, rather than words of limitation. As the present invention may be embodied in several forms without departing from the spirit or essential characteristics thereof, it should also be understood that the above-described embodiment is not limited by any of the details of the foregoing description, unless otherwise specified. Rather, the above-described embodiment should be construed broadly with respect to the appended claims. Therefore, changes may be made within the metes and bounds of the appended claims, as presently stated and as amended, without departing from the scope and spirit of the invention in its aspects.

What is claimed is:

1. A cooling and exhaust system of a dual oven, the system comprising:

a front frame including a first louvered air inlet associated with an upper oven, a second louvered air inlet associated with a lower oven, which has a same structure as the upper oven, and an exhaust outlet;

a cover case including an exhaust passage, the exhaust passage connecting an exhaust duct at a rear of the dual oven and the exhaust outlet;

a first fan directing cooling air through the first louvered air inlet and directing hot air exhausted from the upper oven into the exhaust duct;

a second fan directing cooling air through the second louvered air inlet and directing hot air exhausted from the lower oven into the exhaust duct, wherein the first fan and the second fan are positioned in the same configuration at the rear of each oven, respectively, and thereby vertically aligned with one another;

a fan controller, wherein the fan controller is configured to control the first fan to operate at a high speed relative to the speed of the second fan during a self-cleaning operation of the upper oven and the first fan to operate at a low speed relative to the speed of the second fan during a self-cleaning operation of the lower oven;

a first partition plate provided at an inlet side of the first fan to separate the cooling air introduced from the first louvered air inlet and the hot air exhausted from the upper oven;

a second partition plate, which is angled, provided at an outlet side of the first fan to separate the cooling air and the hot air exhaust separated by the first partition plate and directed to the exhaust duct through the first fan;

a third partition plate provided at an inlet side of the second fan to separate the cooling air introduced from the second louvered air inlet and the hot air exhausted from the lower oven; and a fourth partition plate provided vertically at an outlet side of the second fan to separate the cooling air and the hot air exhausted separated by the third partition plate and directed to the exhaust duct through the second fan.

* * * * *